US008662140B2

(12) United States Patent
Hsieh

(10) Patent No.: US 8,662,140 B2
(45) Date of Patent: Mar. 4, 2014

(54) COMPOSITE PULL-CHAIN DISC MECHANISM WITH BRAKE FUNCTION AND ELECTRIC DOOR OPERATOR INCORPORATED WITH THIS MECHANISM

(76) Inventor: Chung-Hsien Hsieh, New Taipei (TW)

( * ) Notice: Subject to any disclaimer, the term of this patent is extended or adjusted under 35 U.S.C. 154(b) by 179 days.

(21) Appl. No.: 13/424,563

(22) Filed: Mar. 20, 2012

(65) Prior Publication Data

US 2013/0247469 A1 Sep. 26, 2013

(51) Int. Cl.
*A47G 5/02* (2006.01)

(52) U.S. Cl.
USPC ..... 160/310; 160/321; 160/133; 49/139

(58) Field of Classification Search
USPC ..... 160/133, 188, 193, 293.1, 307, 321; 49/139, 140, 199; 192/141; 74/625
See application file for complete search history.

(56) References Cited

U.S. PATENT DOCUMENTS 6,055,885 A * 5/2000 Shea ..... 74/625
6,092,582 A 7/2000 Liu
7,055,283 B2 * 6/2006 Hsieh ..... 49/139
7,503,102 B2 * 3/2009 Hsieh ..... 24/116 R
8,230,759 B2 * 7/2012 Hsieh ..... 74/625
8,286,685 B2 * 10/2012 Hsieh ..... 160/307
8,381,442 B2 * 2/2013 Wan ..... 49/139
8,484,897 B2 * 7/2013 Hsieh ..... 49/199
2005/0172559 A1 * 8/2005 Hsieh ..... 49/140
2010/0132505 A1 * 6/2010 Hsieh ..... 74/625
2012/0024484 A1 * 2/2012 Hsieh ..... 160/291
2012/0061035 A1 * 3/2012 Hsieh ..... 160/293.1
2013/0048440 A1 * 2/2013 Hsieh ..... 188/68
2013/0247469 A1 * 9/2013 Hsieh ..... 49/140

* cited by examiner

*Primary Examiner* — Blair M. Johnson
(74) *Attorney, Agent, or Firm* — Bacon & Thomas, PLLC

(57) ABSTRACT

A composite pull-chain disc mechanism with brake function for a door operator comprises a torsional spring having de-twisting and twisting sides. The weight of a door curtain always acts on the de-twisting sides, so that the inner diameter of the torsional spring is induced to shrink to brake the rotation of the central shaft of the door operator. If twisting sides bears an external force, the inner diameter of the torsional spring is induced to enlarge to release braking of the central shaft. Furthermore, the composite pull-chain disc mechanism can be adapted to an electric door operator. In the case of detaching an electric motor mechanism during maintenance, the door operator can still be operated to open/close a door in a manual mode through the composite pull-chain disc mechanism.

5 Claims, 6 Drawing Sheets

COMPOSITE PULL-CHAIN DISC MECHANISM WITH BRAKE FUNCTION AND ELECTRIC DOOR OPERATOR INCORPORATED WITH THIS MECHANISM

BACKGROUND OF THE INVENTION

1. Field of the Invention

The present invention relates to a composite pull-chain disc mechanism with a brake function for a door operator, and particularly, to an electric door operator incorporated with this composite pull-chain disc mechanism for operating in a manual mode through the composite pull-chain disc mechanism.

2. Description of the Related Art

Generally, a door operator used in, such as a fireproof door or a safety door, basically has an electric motor mechanism to drive a rotating shaft so as to wind a door curtain. A brake mechanism is incorporated for braking the rotating shaft, a pull-chain disc mechanism is used to manually rotate the rotating shaft by means of a pull chain under power failure condition, and an electric clutch mechanism is used to release the brake mechanism or connect the pull-chain disc mechanism by an electromagnet. Furthermore, a lock device for stopping the rotation of the pull-chain disc in an electric operation mode is included, and a brake releasing device is used to release a brake in a manual operation mode.

It is known that a plenty of documents related to door operators are proposed. For example, U.S. Pat. No. 6,092,582 has disclosed the above-described type operation mode, wherein in a manual operation mode, on one hand, a lock device for a pull chain is first released; on the other hand, a brake for the rotating shaft of a door operator is released by a brake releasing device by using a mechanical force, and then, the pull chain is pulled to rotate a pull-chain disc and renders the rotating shaft to rotate. The above-mentioned patent has not only a complicated structure, but also quite inconvenient for operation. In general, once an electric motor mechanism is detached during maintenance for the door operator, a manual mechanism becomes invalid, and hence normal personnel access is affected.

In U.S. Pat. No. 6,055,885 issued to the present applicant, except that a pull-chain disc is used in a manual operation mode under power failure circumstance, the rotation of the pull-chain disc is usually limited by a pull chain, which is locked by a locking device disposed on the housing of a door operator. Therefore, in the case that an electromagnet is not magnetically excited, the pull-chain disc also functions as a brake disc for braking the rotation of the rotating shaft of the door operator. Moreover, in the case that an electric motor mechanism is detached during maintenance, the door operator can still be operated in a manual mode to keep normal personnel access.

Moreover, the present inventor, in U.S. Pat. No. 7,055,283 B2, proposes a control system for switching an electric operation to a manual operation of a door operator, the control system comprising a brake device, used for braking and releasing a rotating shaft of the door operator; a pull-chain disc device, pivoted about a different axle; a clutch device, disposed between the rotating shaft and the pull-chain disc, used for driving the rotating shaft in one direction; a driven disc, linked with the clutch device so as to switch a protective device. As long as the pull chain is pulled, the protective device cuts off an electric circuit for the door operator and releases brake to automatically switch the door operator to a manual mode.

For those skilled in the art there are still spaces for the above-mentioned patents to improve in terms of their usages and structure.

SUMMARY OF THE INVENTION

A main objective of the present invention is to provide a composite pull-chain disc mechanism with brake function for a door operator, thereby improving the complicated structures and inconvenient operations of the prior arts.

In order to accomplish the above objective and other objectives, a door operator is mounted on abase plate, wherein the door operator comprises a central shaft, one end of which is provided with an output wheel for driving a winding shaft, and the other end of which is provided with a composite pull-chain disc mechanism for driving or braking the central shaft. The composite pull-chain disc mechanism comprises a pull-chain disc rotated by a pull chain, within which there is an axial space functioning as an accommodating portion; a partition plate fitted on the right side of the accommodating portion; a protrudent pin secured at a predetermined radial point on the partition plate, one end of the protrudent pin axially protruding toward the left side into the accommodating portion, and the other end of the protrudent pin extending toward the right side of the partition plate to form an extending end. There is a pair of inner hub and outer hub, the inner hub being pivoted to the partition plate, and the outer hub being sleeved on the inner hub in the accommodating portion. And the left end portion of the central shaft passes through the inner hub and is fixed to it into one unit. The right end of the inner hub has a flanged end disc located on the right side of the partition plate. On the end face of the end disc, an elongated arc slot having a predetermined length is formed along a circumference direction at a radius and in correspondence to the radial position of the protrudent pin, to receive the extending end. The left end portion of the outer hub functions as a fixing disc mounted on the base plate. A movable disc is pivoted on the outer hub to rotate around it. At least one torsional spring having an inner diameter can be slidably shrunk on the outer hub at the right side of the movable disc. The torsional spring has two free ends, which are staggered at a predetermined distance in a horizontal direction and formed with radially and outwardly protrudent portions respectively. A pair of bolt rods, fixed on the flanged end disc at predetermined positions outside the two ends of the elongated arc slot, pass through the partition plate and by the outsides of the two protruding portions of the torsional spring, and then is fixed on the movable disc. The protrudent pin stretches in between the two protrudent portions of the torsional spring.

According to the present invention, when a force is exerted on the pull chain to drive the composite pull-chain disc mechanism, the torsional spring is actuated at de-twisting sides, so that the inner diameter of the torsional spring is enlarged to loosen constriction on the outer hub and the central shaft can be rotated. On the contrary, when the pull chain stops exerting a force, the weight of door slats always acts on twisting sides of the torsional spring, so that the inner diameter of the torsional spring is shrunk to constrict on the outer shaft hub to brake the central shaft. It is unnecessary to have any switching device for the start and stop of the door operator. Hence, the operation of the door operator is convenient, the probability of failure is relatively low, and the structure of the door operator can be made simplified and miniaturized.

Furthermore, according to the present invention, an electric door operator incorporated with the composite pull-chain disc mechanism with brake function is provided. The electric motor mechanism, the clutch mechanism, and the composite pull-chain disc mechanism of the door operator are modularized respectively, in which the electrical motor mechanism is detachably connected with the composite pull-chain disc mechanism by means of the clutch mechanism, so that in the case of detaching the electrical motor mechanism during maintenance, the electrical door operator can still be operated to open/close a door in a manual mode through the composite pull-chain disc mechanism. This is another objective of the present invention.

BRIEF DESCRIPTION OF THE DRAWINGS

Hereinafter, the technical features of the present invention are further described in cooperation with drawings. The drawings and the associated descriptions are provided to illustrate the embodiments which are preferred examples only and are not used to limit the scope of implementation of the present invention. The invention is better understood from the following detailed description with reference to the accompanying drawings.

DESCRIPTION OF THE PREFERRED EMBODIMENTS

Figures 1, 1A:
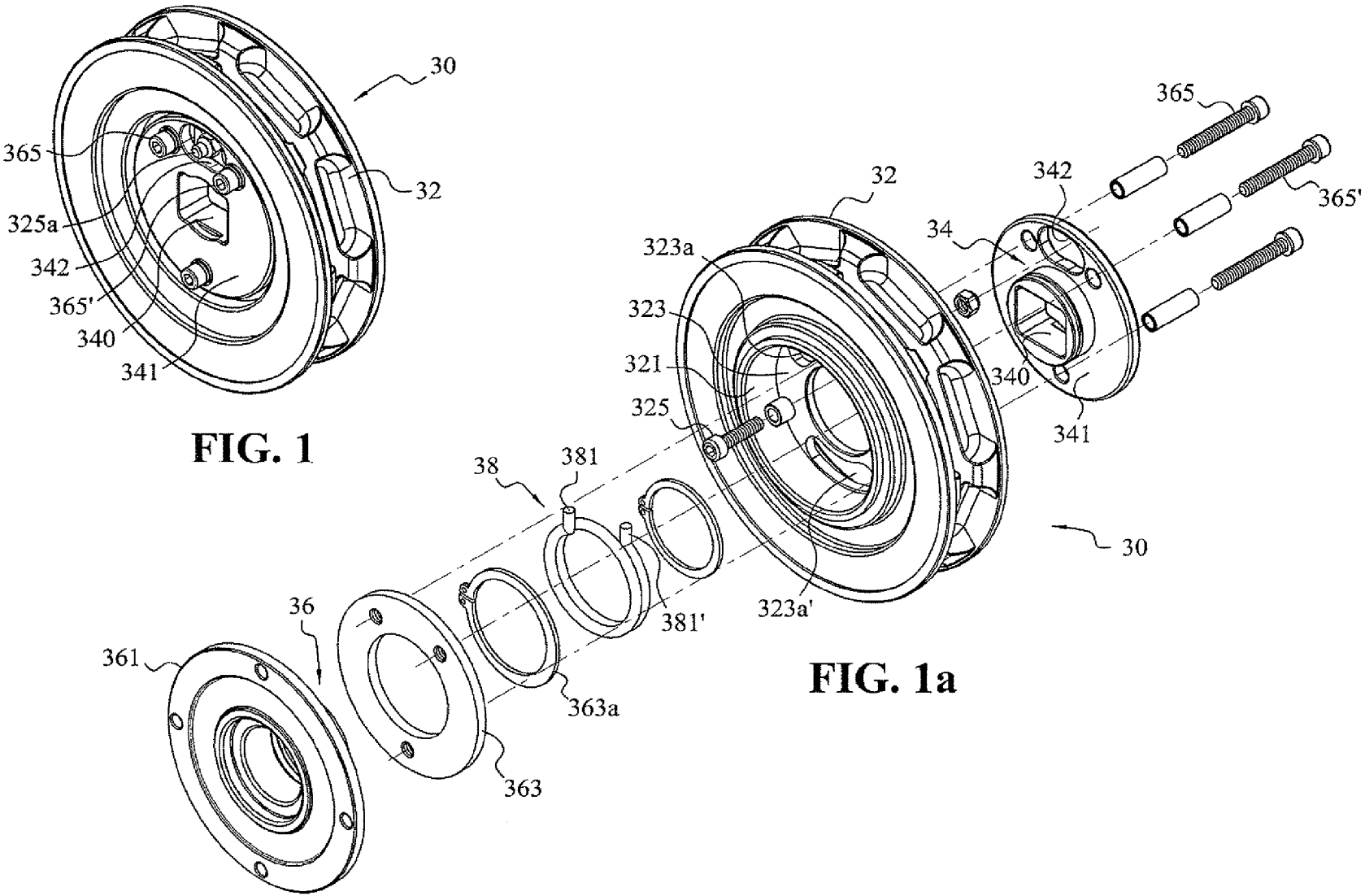
FIG. 1 is a perspective view showing a composite pull-chain disc mechanism with a brake function of the present invention.
FIG. 1*a* is an exploded perspective view of the composite pull-chain disc mechanism viewed in the rear direction to that of FIG. 1.
Figure 1D:
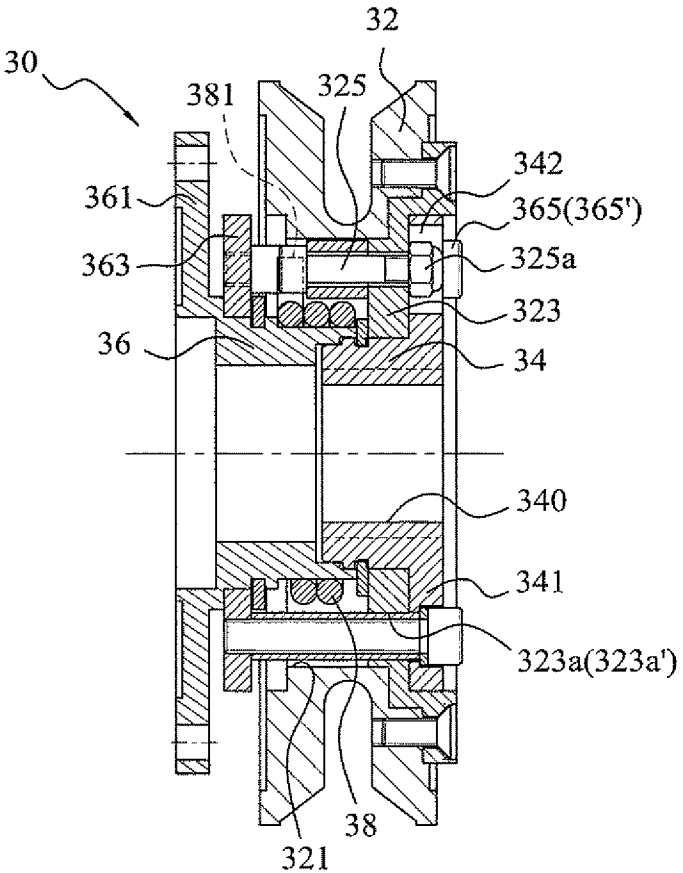
FIG. 1*d* is a cross-sectional view of the composite pull-chain disc mechanism of FIG. 1*a* as in assembled condition.
Figure 1C:
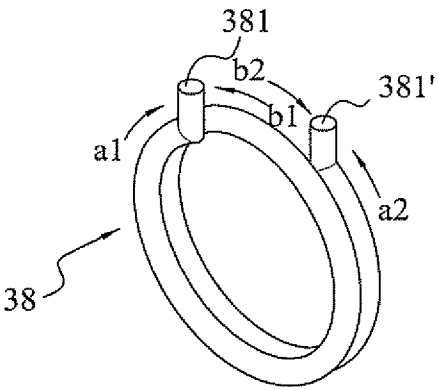
FIG. 1*c* is a perspective view of a torsional spring mechanism of the present invention.
Figure 1B:
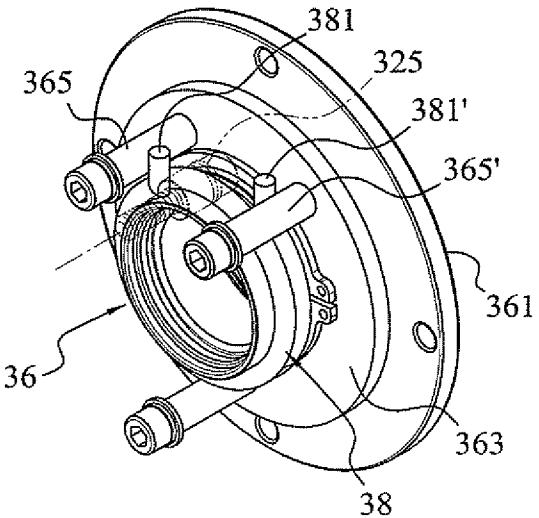
FIG. 1*b* is a perspective view showing the internal structure of the composite pull-chain disc mechanism of FIG. 1 with the pull-chain disc detached.
Figure 1F:
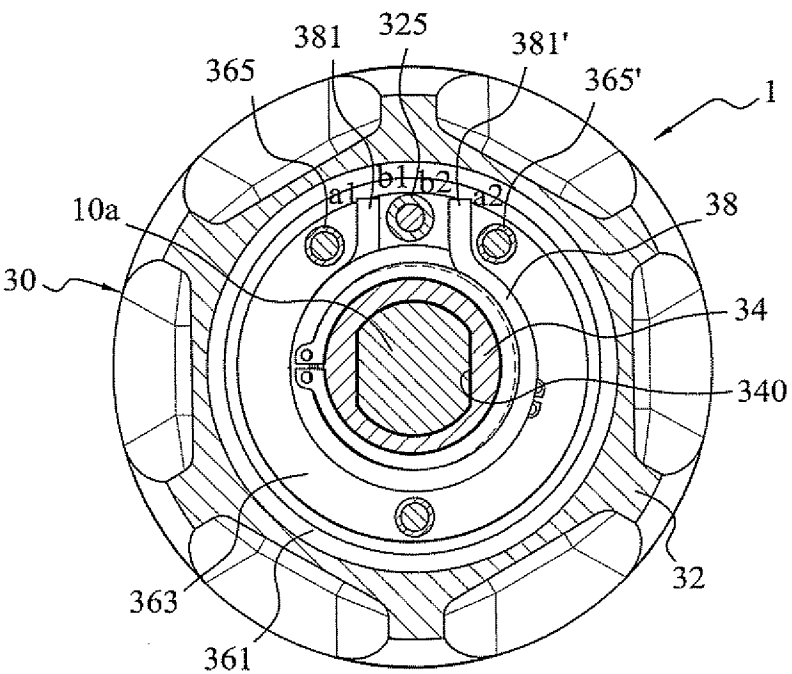
FIG. 1*f* is a cross-sectional view of FIG. 1*e* along a line 1*f*-1*f* in FIG. 1*e*.
Figure 1E:
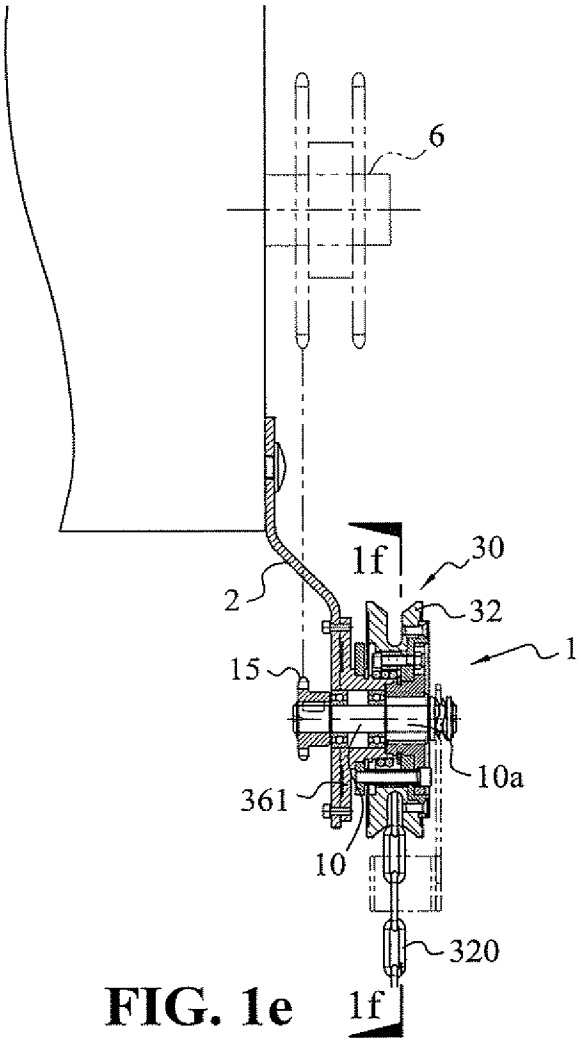
FIG. 1*e* is a schematic view shown that the composite pull-chain disc mechanism with the brake function of the present invention is applied to a hand-operated door operator.

First, FIGS. 1 to 1*d* of the present invention illustrate an embodiment of a composite pull-chain disc mechanism 30 with a brake function, and FIGS. 1*e* and 1*f* illustrate a hand-operated door operator with the composite pull-chain disc mechanism 30 installed thereon. According to the present invention, as shown in FIG. 1*e*, the door operator 1 is basically mounted on a base plate 2, wherein the door operator 1 comprises a central shaft 10, one end of which is provided with an output wheel 15 for rotating a winding shaft 6 for a curtain of door slats, and the other end of which is provided with the composite pull-chain disc mechanism 30 for rotating or braking the central shaft 10. The composite pull-chain disc mechanism 30 comprises a pull-chain disc 32 with a pull chain 320 running over it. As shown in FIG. 1*a*, inside the pull-chain disc 32, there is an axial space functioning as an accommodating chamber 321. On the right side of the accommodating chamber 321, there is provided a partition plate 323. A protrudent pin 325 is secured at a predetermined radial point on the partition plate 323. One end of the protrudent pin 325 axially protrudes leftward into the accommodating chamber 321, and the other end of the protrudent pin 325 extends toward the right side of the partition plate 323 to form an extending end 325*a*. There is a pair of inner hub 34 and outer hub 36, wherein the inner hub 34 is pivoted to the partition plate 323, and the outer hub 36 is sleeved over the inner hub 34. The central shaft 10 passes through the inner hub 34 and is fixed thereto integrally. As shown in FIG. 1*a*, the right end of the inner hub 34 has a flanged end disc 341, which is located at the right side surface of the partition plate 323. On the surface of the end disc 341, an elongated arc slot 342, having a predetermined arc length, is formed along a circumference direction at a radius in correspondence to the radial position of the protrudent pin 325, for receiving the extending end 325*a* as shown in FIGS. 1 and 1*d*. As shown in FIG. 1*d*, on the left end side of the outer hub 36, there is a fixing disc 361 for fixing on the base plate 2. Also, a movable disc 363, pivoted on the outer hub 36 and stopped by a spring ring 363*a*, is rotatable around the outer hub 36. At least one torsional spring 38 having an inner diameter slidably constricts on the outer hub 36 at the right side of the movable disc 363. The two ends of the torsional spring 38 are free ends, which are staggered with a predetermined distance in a horizontal direction and formed with radially and outwardly protruding portions 381 and 381' respectively. A pair of bolt rods 365 and 365' are disposed adjacent to the left and right sides of the elongated arc slot 342 of the end disc 341 (referring to FIGS. 1 and 1*a*). On the partition plate 323, a pair of through slots 323*a* and 323*a'* corresponding to each of the bolt rods 365 and 365' are formed to allow the bolt rods 365 and 365' to pass through freely. One end of each bolt rod 365 and 365' is fixed on the end disc 341, the other end passes through the partition plate 323 and by the outsides of the two protruding portions 381 and 381' of the torsional spring 38, and then fixes with the movable disc 363 together with an effect that the torsional spring 38 is nested within the accommodating chamber 321, and the protrudent pin 325 protrudes and stretches in between the two protruding portions 381 and 381' (as shown in FIGS. 1-1*d* and 1*f*).

Referring to FIG. 1*c*, each of the protruding portions 381 and 381' of the torsional spring 38 has twisting sides a1 and a2 and de-twisting sides b1 and b2. The bolt rods 365 and 365' are located in the twisting sides, a1 and a2 of the protruding portions 381 and 381' respectively, that is, outsides of the protruding portions 381 and 381'. The protrudent pin 325 is located between the de-twisting sides b1 and b2 of the protruding portions 381 and 381', that is, between the protruding portions 381 and 381'. Referring to FIG. 1*f*, a center hole 340 of the inner hub 34, is a square hole in section, and the left portion 10*a* of the central shaft 10 is formed with a correspondent square shape in section, so that the square end 10*a* are engaged with the square hole 340.

Referring to FIG. 1, FIG. 1*a*, FIG. 1*b* and FIG. 1*c*, since the extending end 325*a* of the protrudent pin 325 is nested within the elongated arc slot 342 of the end disc 341 of the inner hub 34, when a force exerts on the pull chain 320 to drive the pull-chain disc 32, the protrudent pin 325 fixed on the partition plate 323 first actuates the protruding portion 381 (or 381') of the torsional spring 38 from the de-twisting side b1 (or b2), so that the inner diameter of the torsional spring 38 is enlarged and loosens its constriction on the outer hub 36 with an effect that the pull-chain disc 32 is rotated along. At this time, the extending end 325*a* of the protrudent pin 325 presses against the end of the elongated arc slot 342 accordingly to actuate the end disc 341 of the inner hub 34, so that the central shaft 10 is rotated along with the inner hub 34, and the driving force is transmitted directly to the winding shaft 6 via the output wheel 15 to open or close a door. On the contrary, when the pull chain 320 stops exerting a force, the weight of the door curtain acts on the output wheel 15 and transmits back to the central shaft 10 and renders the inner hub 34 to have a tendency to rotate accordingly. Since the protruding portion 381 and 381' of the free ends of the torsional spring 38 is located between the bolt rods 365 and 365', the rotation tendency of the inner hub 34 renders the bolt rods 365 (365') to abut against the twisting side a2 of the torsional spring and push on the twisting side a2, thereby further constricts the torsional spring 38 on the out hub 36, so that the rotation of the central shaft 10 is braked.

In this way, the structure for a door operator can be simplified and miniaturized by using the composite pull-chain disc mechanism with a torsional spring 38 for braking the central shaft 10 in the twisting directions of the torsional spring 38 and for transmitting an exerting force from the pull chain to rotate the central shaft 10 in the de-twisting directions of the torsional spring 30, with a effect that a switching over the start and the stop mode operations of the door operator is automatic.

FIGS. 2 and 2*a* to 2*d* explain an embodiment of an electric door operator in which the composite pull-chain disc mechanism with the brake function of the present invention is applied to the electric door operator, for the effect that in the case of detaching an electric motor mechanism during maintenance, the electric door operator can be still operated to open/close a door in a manual mode through the pull-chain disc composite mechanism, thereby allowing personnel access.

According to embodiment of the present invention, an electric door operator 1' comprises a housing 1*a* for mounting an electric motor mechanism 20. A rotating shaft 10' of the electric motor mechanism 20 is connected to the central shaft 10 via a coupling 11 and detachably connected to a composite pull-chain disc mechanism 30 having a brake function by means of a clutch mechanism 22. The rotation of the rotating shaft 10' of the electric motor mechanism 20 is transmitted to the output wheel 15 fixed on an output shaft 10" via the central shaft 10 after the rotating speed of the rotating shaft 10' is reduced by a train of gears 404 and 401" to rotate a winding shaft for a door curtain (not shown). As the construction of the composite pull-chain disc mechanism 30 is the same as that of the above-described embodiment (referring to FIGS. 1 to 1*d*), its description is omitted hereinafter.

Figure 2:
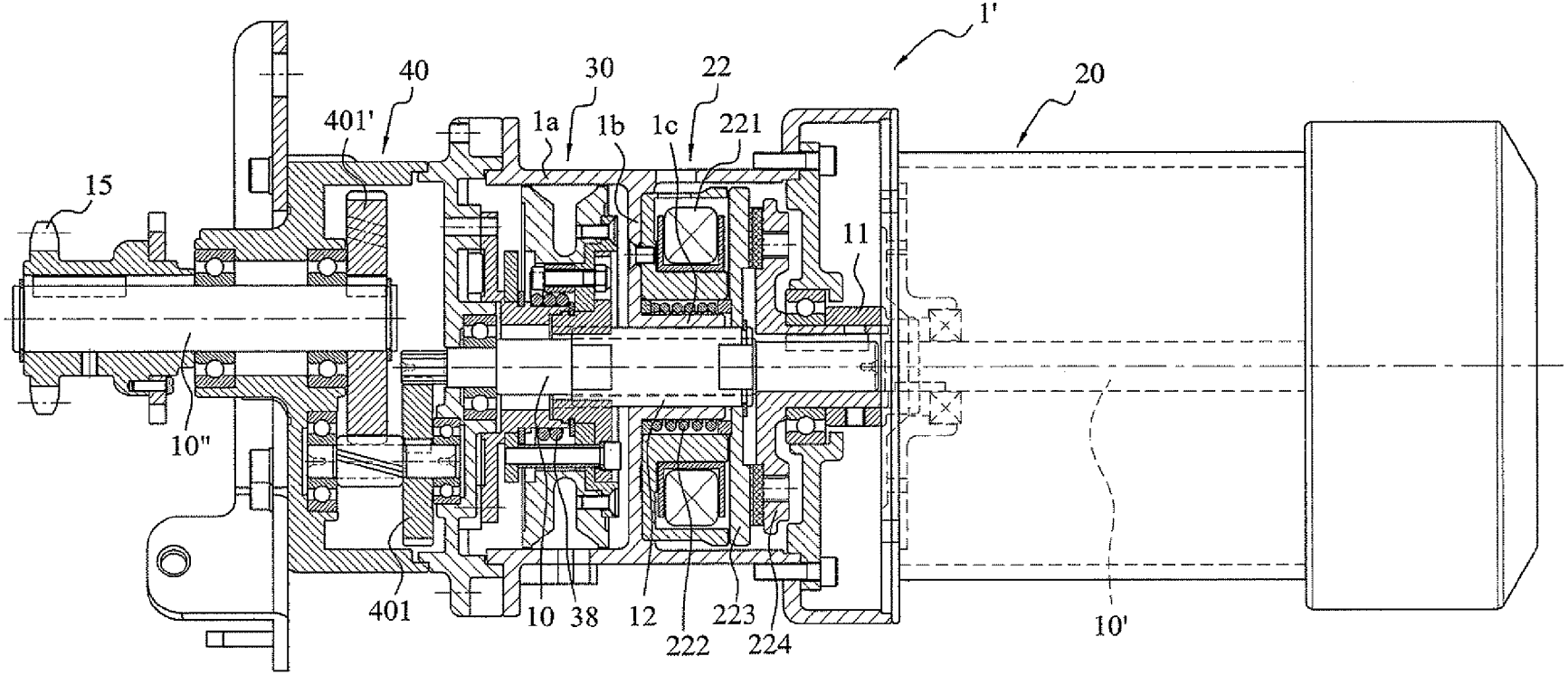
FIG. 2 is a cross-sectional view showing that the composite pull-chain disc mechanism with the brake function of the present invention is applied to an electric door operator.
Figure 2A:
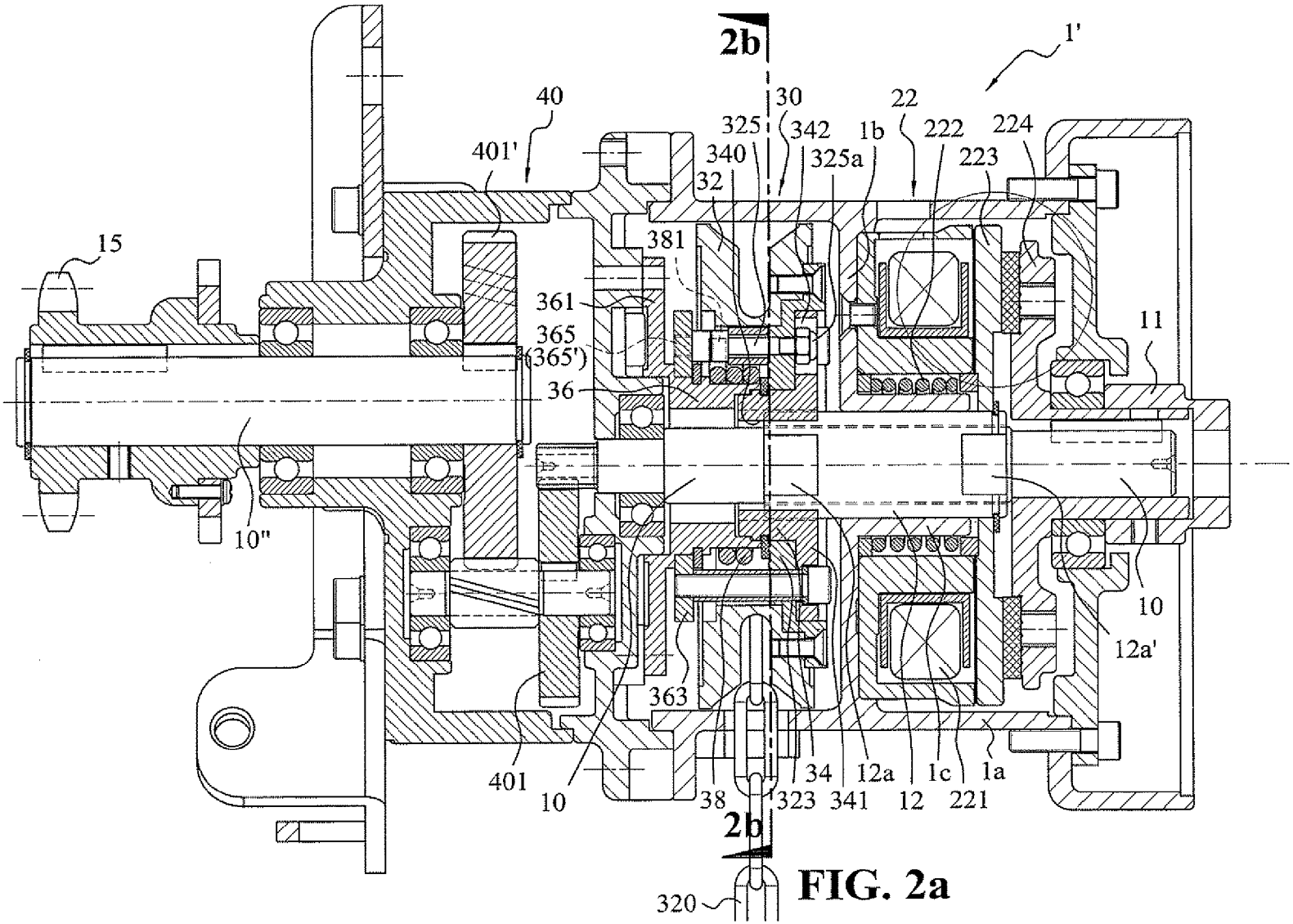
FIG. 2*a* is a cross-sectional view showing the electric door operator of FIG. 2 with an electrical motor mechanism detached.
Figure 2C:
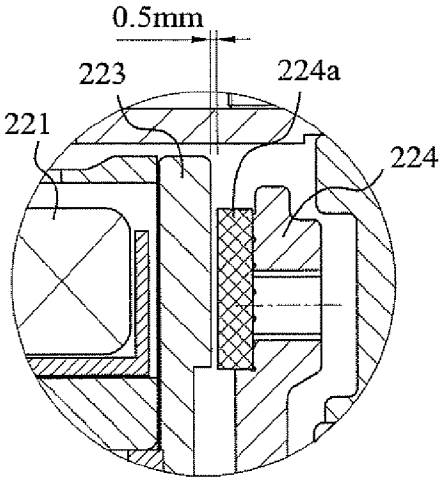
FIG. 2*c* is a partly enlarged view of a circled portion in FIG. 2*a*, wherein a clutch mechanism is in a detached state.
Figure 2D:
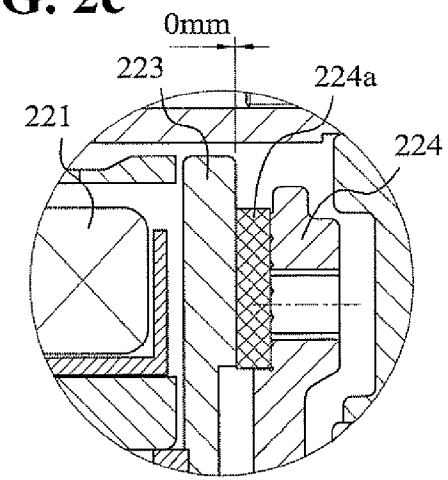
FIG. 2*d* is a partly enlarged view of the circled portion in FIG. 2*a*, wherein the clutch mechanism is in a coupling state.
Figure 2B:
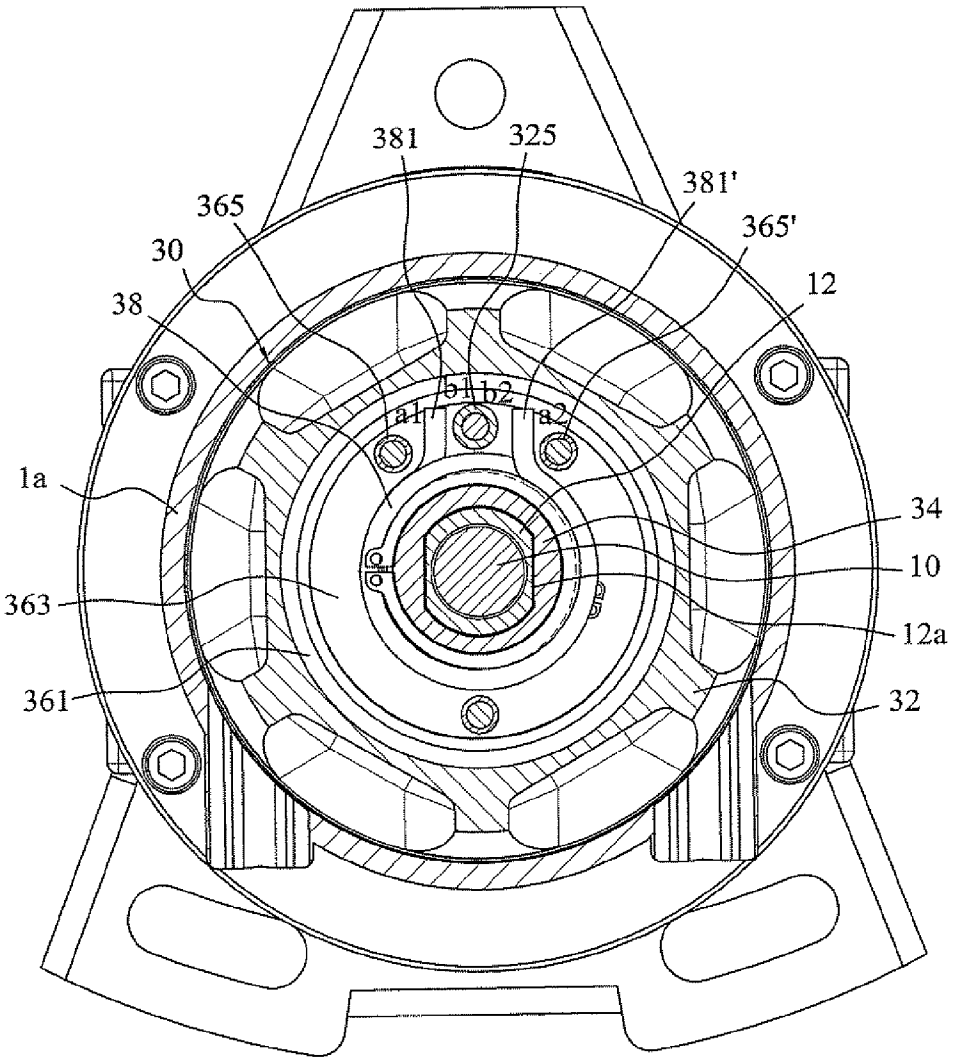
FIG. 2*b* is a cross-sectional view along a line 2*b*-2*b* in FIG. 2*a*.

As shown in FIGS. 2 and 2*a* to 2*b*, a housing 1*a* includes a vertical partition plate 1*b* therein, from the right side surface of which a bearing portion 1*c* is formed. A sleeve 12 is placed over the central shaft 10 between the two ends thereof, and can be axially slided within the bearing portion 1*c*. Each end portion of the sleeve 12 is formed with a square end 12*a* and 12*a'* in section. The composite pull-chain disc mechanism 30 having the brake function is disposed on the left side portion of the central shaft 10, having the square hole 340 formed at the center portion of the inner hub 34. The square end 12*a* at the left end of the sleeve 12 is correspondingly engaged with the square hole 340. The clutch mechanism 22 comprises an electromagnet 221 fixed on the partition plat 1*b*, and a radial accommodating space for accommodating an elastic element 222 is formed between the electromagnet 221 and the peripheral surface of the bearing portion 1*c*. A driving disc 224 is fixed at the left end portion of the rotating shaft 10', and has a left end face faced to the electromagnet 221 with a brake shoe piece 224*a* disposed thereon. A driven disc 223 is located in the axial direction between the electromagnet 221 and the driving disc 224, and engages with the square end 12*a'* of the right end of the sleeve 12. The driven disc 223 is biased by the elastic element 222 and always abuts against the brake shoe piece 224*a* of the driving disc 224.

As to the present invention, a conventional control circuit is used. When the electric motor mechanism 20 is electrically powered to be in an electrodynamic operation mode (i.e., in the case of clockwise or anticlockwise rotation), the control circuit excites the electromagnet 221 of the clutch mechanism 22, so that the driven disc 223 resists against the potential energy of the elastic element 222 and is attracted leftward by the electromagnet 221 to separate from the brake shoe piece 224*a*(as shown in FIG. 2*c*). At this time, rotation of the rotating shaft 10' of the electric motor mechanism 20 is directly transmitted to the output shaft 10" via the central shaft 10 and a reduction mechanism 40, and winds the door curtain on the winding shaft (not shown) through the output wheel 15, thereby opening or closing the door curtain. However, when the electric motor mechanism 20 is power-off (i.e., in the case of stop period), the electromagnet 221 of the clutch mechanism 22 is not excited, so that the driven disc 223 is biased by the potential energy of the elastic element 222, and then abuts against the driving disc 224 (as shown in FIG. 2*d*). At this point, the falling tendency due to the gravity weight of the door curtain always acts on the output wheel 15 and is transmitted back to the sleeve 12 via the output shaft 10", the reduction mechanism 40, and the central shaft 10, the driving disc 224 and the driven disc 223 for the inner hub 34 to have a clockwise rotation tendency. As a result, the bolt piece 365 (365'), which is fixed on the end disc 341 of the inner hub 34 is intending to rotate and abut against the clockwise side, for example, a2 of the torsional spring 381. Hence, the torsional spring 38 is constricted on the outer hub 36 and brake the rotation of the central shaft 10, as shown in FIGS. 1*b* and 2*b*. Moreover, as shown in FIG. 2*a*, which is in the case of detaching the electric motor mechanism 20 of the door operator 1', when a force is exerted on the pull chain 320 to rotate the pull-chain disc 32, a driving force is transmitted to the output shaft 10" via the inner hub 34, the sleeve 12, the driven disc 223, the driving disc 224, the central shaft 10, and the reduction mechanism 40 to open or close the door, in which the composite pull-chain disc is working in the same way as that of the foregoing embodiment and hence its description is not further described.

In this way, even in the case of detaching the electric motor mechanism 20 during maintenance or the electric motor being out of order, the door operator 1' can still be operated to open/close the door in a manual mode through the composite pull-chain disc mechanism 30 so as to keep normal personnel access.

LIST OF REFERENCE NUMERALS

1, 1' door operator
1*a* housing
1*b* partition
1*c* bearing portion
2 base plate
6 winding shaft
10 central shaft
10' rotating shaft
10" output shaft

11 coupling
12 sleeve
12*a*, 12*a*' square end
15 output wheel
20 electric motor mechanism
22 clutch mechanism
221 electromagnet
222 elastic element
223 driven disc
224 driving disc
224*a* brake shoe piece
30 composite pull-chain disc mechanism
32 pull chain disc
320 pull chain
321 accommodating chamber
323 partition plate
323*a*, 323*a*' elongated slot
325 protrudent pin
325*a* extending end
34 inner hub
340 square groove
341 end disc
342 elongated slot
36 outer hub
361 fixing disc
363 movable disc
363*a* spring ring
365, 365' bolt rod
38 torsional spring mechanism
381, 381' protruding portion
40 reduction mechanism
401, 401' gear sets

What is claimed is:

1. A composite pull-chain disc mechanism with a brake function for a door operator (1), the door operator (1) mounted on a base plate (2) comprising a central shaft (10), one end of which is provided with an output wheel (15) for rotating a winding shaft (6) for a door curtain of slats, and the other end of which is provided with the composite pull-chain disc mechanism (30) for rotating or braking the central shaft (10); wherein the composite pull-chain disc mechanism (30) comprises:

a pull-chain disc (32) rotated by a pull chain (320), having: an axial space functioning as an accommodating chamber (321) within the pull-chain disc (32); a partition plate (323) fixed on the right side of the accommodating chamber (321); and a protrudent pin (325) secured at a predetermined radial point on the partition plate (323), the left one end of the protrudent pin (325) axially extending into the accommodating chamber (321), and the right end of the protrudent pin (325) extending out of the right side of the partition plate (323) to form an extending end (325*a*);

a pair of hubs comprising an inner hub (34) and outer hub (36), the inner hub (34) being pivoted to the partition plate (323), and in the accommodating chamber (321), the inner hub (34) being sleeved within the outer hub (36), in which the central shaft (10) passing through the inner hub (34) and connected therewith integrally; wherein the right end of the inner hub (34) has a flanged end disc (341) located at the right side of the partition plate (323), and on the end face of the end disc (341), an arc slot (342) having a predetermined arc length is formed along a circumference direction with a radius in correspondence to the radial position of the protrudent pin (325) to receive the extending end (325*a*); and the left end side of the outer hub (36) is fixed on the base plate (2);

a movable disc (363) pivoted around the outer hub (36);

at least one torsional spring (38), having an inner diameter, and constricting on the outer hub (36) at the right side of the movable disc (363), wherein two ends of the torsional spring (38) are free ends, which are staggered at a predetermined distance in a horizontal direction and formed with radially and outwardly protruding portions (381, 381') respectively;

a pair of bolt rods (365, 365'), passing from the end disc (341) of the inner hub (34) through the partition plate (323) and passing by outsides, respectively, of the two protruding portions (381, 381') of the torsional spring (38), and then fixed on the movable disc (363), wherein the protrudent pin (325) protrudes in between the two protruding portions (381, 381') of the torsional spring (38).

2. The composite pull-chain disc mechanism as claimed in claim 1, wherein on the partition plate (323), at least two elongated through slots (323*a*, 323*a*') corresponding to the bolt rods (365, 365') are formed to allow the bolt rods (365, 365') to pass through freely.

3. The composite pull-chain disc mechanism as claimed in claim 2, wherein at the center of the inner hub (34), there is a square groove (340) in section, and the central shaft (10) is correspondingly formed with a square end (10*a*) in section, the square groove (340) being engaged with the square end (10*a*).

4. A composite hand-operated and electric motor-operated door operator (1), comprising: a housing (1*a*) for accommodating an electric motor mechanism (20) which has a rotating shaft (10') connected to a central shaft (10) via a clutch mechanism (22) for coupling or de-coupling a hand-operated pull-chain disc mechanism (30) with a brake function; wherein the hand-operated pull-chain disc mechanism (30) having the brake function disposed on the central shaft (10) for hand-operating or braking the central shaft (10), and comprising:

a pull-chain disc (32), rotated by a pull chain (320), having: an axial space functioning as an accommodating chamber (321) within the pull-chain disc (32); a partition plate (323) fixed on the right side of the accommodating chamber (321); and a protrudent pin (325) secured at a predetermined radial point on the partition plate (323), the left end of the protrudent pin (325) axially extending into the accommodating chamber (321), and the right end of the protrudent pin (325) extending out of the right side of the partition plate (323) to form an extending end (325*a*);

a pair of hubs comprising an inner hub (34) and outer hub (36), the inner hub (34) being pivoted to the partition plate (323), and in the accommodating chamber (321), the inner hub (34) being sleeved within the outer hub (36), in which the central shaft (10) passing through the inner hub (34) and connected therewith integrally; wherein the right end of the inner hub (34) has a flanged end disc (341) located at the right side of the partition plate (323), and on the end face of the end disc (341), an arc slot (342) having a predetermined arc length is formed along a circumference direction with a radius in correspondence to the radial position of the protrudent pin (325) to receive the extending end (325*a*); and the left end side of the outer hub (36) is fixed on the base plate (2);

a movable disc (363), pivoted on the outer hub (36) to rotate around the outer hub (36);

at least one torsional spring (38), having an inner diameter, and constricting on the outer hub (36) at the right side of the movable disc (363), wherein two ends of the torsional spring (38) are free ends, which are staggered at a predetermined distance in a horizontal direction and formed with radially and outwardly protruding portions (381, 381') respectively;

a pair of bolt rods (365, 365'), passing from the end disc (341) of the inner hub (34) through the partition plate (323) and passing by outsides, respectively, of the two protruding portions (381, 381') of the torsional spring (38), and then fixed on the movable disc (363), wherein the protrudent pin (325) protrudes in between the two protruding portions (381, 381') of the torsional spring;

wherein the housing (1*a*) comprises a vertical radial partition plate (1*b*), in which a bearing portion (1*c*) is formed in a horizontal direction; a sleeve (12) sleeved between the two ends of the central shaft (10) and pivoted in the bearing portion (1*c*) to axially slide, each end of the sleeve (12) being formed with square end (12*a*, 12*a'*) in section; the pull-chain disc mechanism (30) with the brake function disposed along the left side of the central shaft (10); a square groove (340) in section formed at the center of the inner hub (34) and correspondingly engaged with the left square end (12*a*) of the sleeve (12); and wherein the clutch mechanism (22) comprises: an electromagnet (221) fixed on the partition plate (1*b*), and a radial accommodating space for accommodating an elastic element (222) formed between the electromagnet (221) and a peripheral surface of the bearing portion (1*c*); a driving disc (224), being fixed at the right end of the central shaft (10), and having an end face disposed with a brake shoe piece (224*a*) facing the electromagnet (221); a driven disc (223) located between the electromagnet (221) and the driving disc (224), and engaging with the square end (12*a'*) on the right end side of the sleeve (12); and the driven disc (223) biased by the potential energy of the elastic element 222 to always abut against the brake shoe piece (224*a*) of the driving disc (224).

5. The composite hand-operated and electric motor-operated door operator as claimed in claim 4, wherein in the case of detaching the electric motor mechanism (20), the door operator (1') is operated by exerting a force on the pull chain (320) to rotate the winding shaft of door curtain.

* * * * *